US006702157B1

(12) United States Patent
Dobbs

(10) Patent No.: US 6,702,157 B1
(45) Date of Patent: Mar. 9, 2004

(54) SELF-ALIGNING PUMP ASSEMBLY

(75) Inventor: Douglas B. Dobbs, Yorba Linda, CA (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 10/372,894

(22) Filed: Feb. 26, 2003

(51) Int. Cl.[7] ..... B65D 88/54

(52) U.S. Cl. ..... 222/321.7; 222/153.09; 222/468

(58) Field of Search ..... 222/321.7, 321.9, 222/153.09, 153.13, 465.1, 464.1, 382, 383.1, 542, 568, 478, 481.5; 215/211, 307; 239/333, 329

(56) References Cited

U.S. PATENT DOCUMENTS

| | | | | |
|---|---|---|---|---|
| 3,066,819 A | | 12/1962 | Cox | 215/1 |
| 3,327,752 A | | 6/1967 | Davis | 150/52 |
| 4,781,311 A | * | 11/1988 | Dunning et al. | 222/153.09 |
| 4,863,071 A | | 9/1989 | Guss et al. | 222/207 |
| 5,192,007 A | | 3/1993 | Blomquist | 222/376 |
| 5,199,613 A | * | 4/1993 | Magrath et al. | 222/153.09 |
| 5,246,146 A | | 9/1993 | Bartimes et al. | 222/382 |
| 5,810,209 A | * | 9/1998 | Foster | 222/383.1 |
| 5,845,820 A | * | 12/1998 | Foster | 222/383.1 |
| 6,032,814 A | * | 3/2000 | Foster | 215/332 |

FOREIGN PATENT DOCUMENTS

| | | |
|---|---|---|
| GB | 2 240 330 | 7/1991 |

* cited by examiner

*Primary Examiner*—Gene Mancene
*Assistant Examiner*—Frederick Nicolas
(74) *Attorney, Agent, or Firm*—Dykema Gossett PLLC

(57) ABSTRACT

A manually actuated pump dispenser assembly has a positioning leg on an eccentric flange thereof to facilitate the offset mounting of the assembly to an offset opening in the neck of a container of liquid to which the pump assembly is to be mounted. And, an arcuate skirt associated with the leg positively interferes with an improper mounting of the pump assembly in place.

10 Claims, 2 Drawing Sheets

29
31
32
27
10
28
11
33
3
3
35
36

21
38
22
23
19
24
25
26

37
11
33
36
28
35
19
27

SELF-ALIGNING PUMP ASSEMBLY

BACKGROUND OF THE INVENTION

This invention relates generally to a manually actuated dispensing pump assembly, and more particularly to such an assembly designed for mounting to an eccentric container neck opening of a container liquid to be pumped by the dispenser to effect proper orientation of the assembly in only one position.

Many liquid containers beyond a certain size have an integral handle for ease in handling the container and in pouring out its contents. The handle may be hollow for establishing a vent path extending from an opening within the container neck to a head space above the liquid in the container. This vent allows air to ingress from the pour spout as product is dispensed to prevent the intermittent venting of air through the product itself. The standard non-vented jug creates surging of the dispensed product as air enters through the product to replace the dispensed product volume in the container. This results in splashing of the product that is detrimental to the user especially when pouring a strong caustic liquid such as a laundry bleach.

It has become desirable to mount a liquid pump dispenser to such a vented container for especially commercial applications that require a dosed amount for a volume of water to achieve a regulatory concentration used to disinfect restaurant kitchens, and the like. However, the vent feature in the container opening prevents the pump cylinder, also known as the accumulator body of the pump, from centering in the threaded container opening. Consequently, the pump is forced into an eccentric orientation relative to the threaded opening, such that the pump cannot be properly threaded onto the container to achieve a sealed fit.

The need therefore arises to provide a self-aligning and anti-rotational pump assembly which will permit the assembly to be mounted within the eccentric container neck opening to assure a complete 360 degree contact of the pump flange to the threaded neck finish of the container when mounting the assembly in place.

SUMMARY OF THE INVENTION

It is therefore an object of the present invention to provide a manually actuated pump dispenser assembly designed specifically to be mounted within an offset opening within the neck of a liquid container so as to be self-aligned without rotation to assure a full 360 degree contact between the pump body flange which supports the threaded closure, and the outer edge of the container neck to avoid any leakage after the closure is torqued down over the container neck finish.

In accordance with the invention, the flange on the pump cylinder or accumulator which supports the threaded closure is eccentric relative to the pump cylinder and presents a portion of greatest extension from the pump cylinder from which a positioning leg depends for preventing relative rotation of the assembly as the leg extends into the vent opening located within the container neck opening. Means such as a skirt on the portion of the eccentric flange which extends greatest from the pump cylinder, is designed to interfere with the thread mounting of the assembly in positions other than the proper orientation of the assembly relative to the eccentric container neck opening. The skirt is arcuate and is associated with the positioning leg such that if an attempt is made to mount the assembly to the container without anchoring the positioning leg in the vent opening, the arcuate skirt interferes with the container neck and prevents the torquing down of the closure on the neck.

Other objects, advantages, and novel features of the invention will become more apparent from the following detailed description of the invention when taken in conjunction with the accompanying drawings.

DETAILED DESCRIPTION OF THE INVENTION

Figure 1:
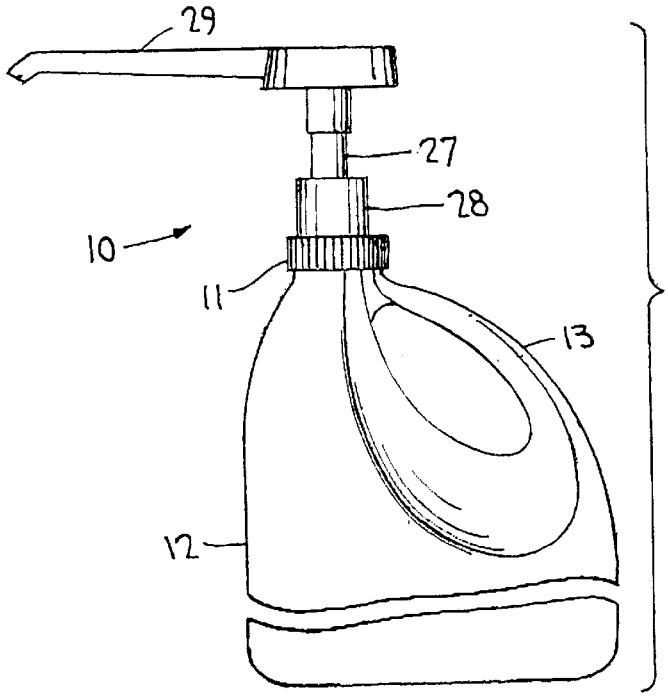
FIG. 1 is a side elevational view of the pump dispenser assembly of the invention shown mounted on a container.
Figure 4:
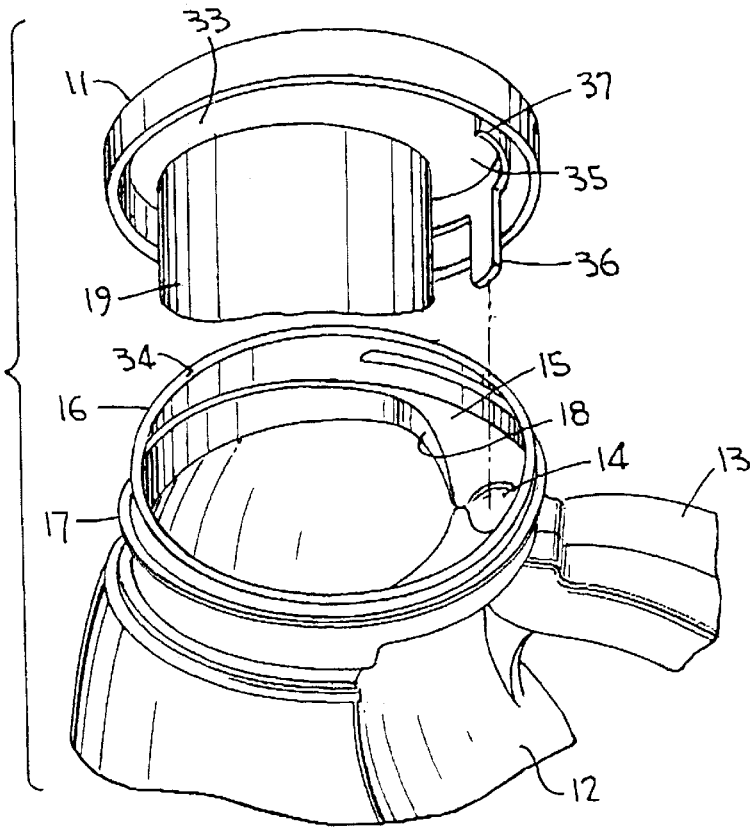
FIG. 4 is a perspective view at an enlarged scale illustrating the self-aligning and anti-rotational feature of the invention.

Turning now to the drawings wherein like reference characters refer to like and corresponding parts throughout the several views, the pump assembly according to the invention is generally designated 10 in FIG. 1 as shown mounted via its internally threaded closure 11 to a container 12 of liquid to be pumped. The container is of molded plastic construction having a handle 13 which is hollow defining a vent path (not shown) extending from within the container to a vent port 14 as shown in FIG. 4 as terminating in a shelf 15 molded within container neck 16 externally threaded as at 17. The container is of the type initially designed to be capped by a closure cap (not shown) internally threaded for threaded engagement with the threaded container neck. The container neck normally comprises a pouring spout having an opening 18 comprising a constricted neck opening which lies eccentric to the central axis of the container neck by reason of shelf 15 projecting into the container neck opening.

The vent provided by hollow handle 13 allows air to ingress from the pour spout as product is dispensed to prevent the intermittent venting of air through the product itself as would normally be the case without provision of aid for venting. The standard non-vented container creates surging of the dispensed product as air enters through the product to replace the dispensed product of volume in the container. The subsequent splashing of the product is detrimental to the user especially when the liquid being poured is a strong caustic liquid such as a laundry bleach.

The pump dispenser assembly according to the invention is generally of a well-known variety such as that disclosed in U.S. Pat. No. 3,128,018, but forms no part of the invention. The dispenser is to be mounted to container 12 for possible commercial application requiring a dosed amount for a volume of water to achieve a regulatory concentration used to disinfect restaurant kitchens, and the like. The vent feature of the container at its container neck opening, however, prevents the accumulator body 19 of the dispenser, in the form of a pump cylinder, from centering in the threaded container neck opening 18 which is eccentric relative to the container neck. Consequently, the pump will be forced into an eccentric orientation relative to the container neck such that the pump dispenser assembly cannot be threaded onto the container to achieve a sealed fit.

Figures 2, 3:
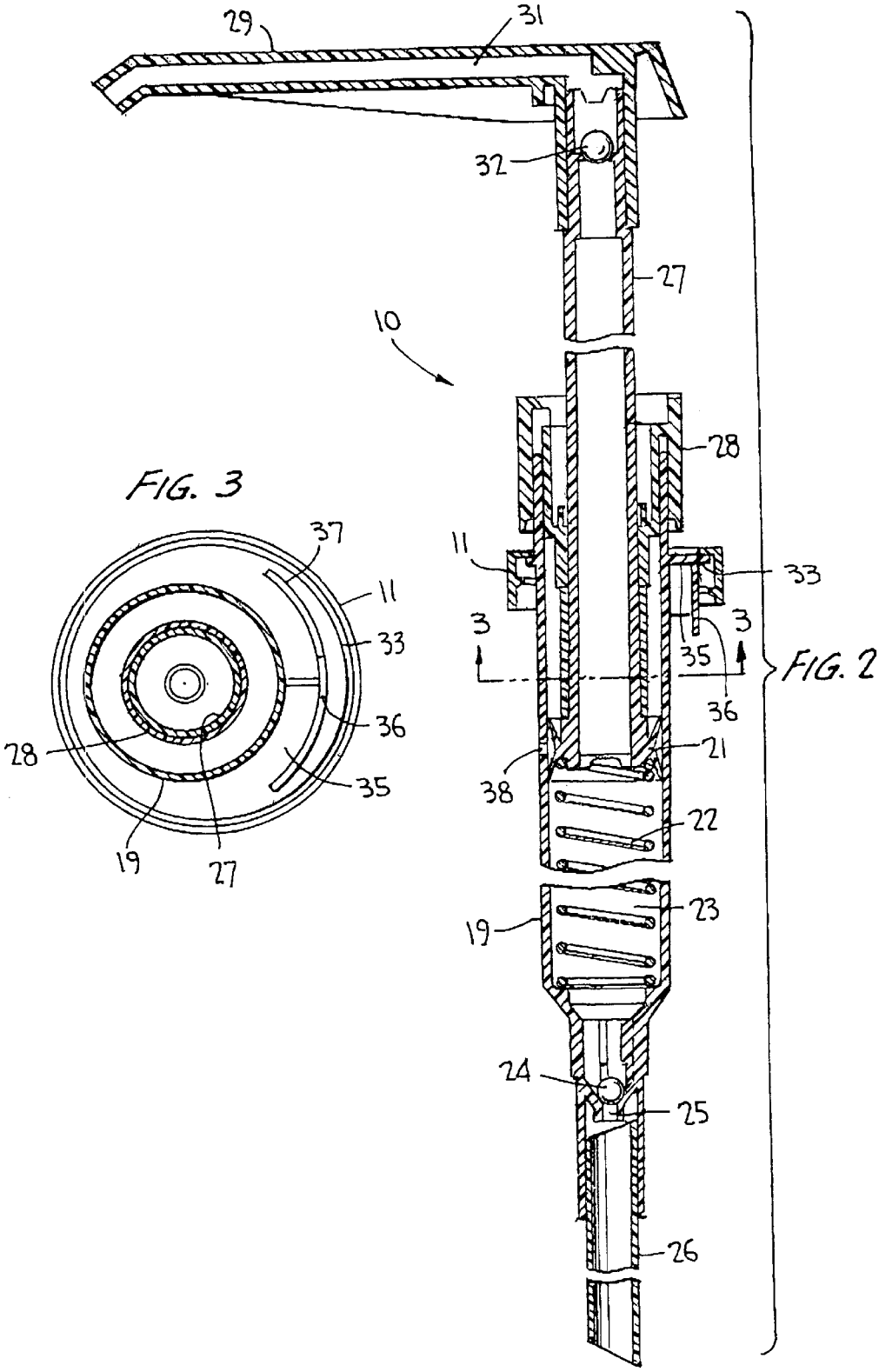
FIG. 2 is a vertical sectional view of the pump dispenser assembly of FIG. 1.
FIG. 3 is a view at a slightly enlarged scale taken substantially along the line 3—3 of FIG. 2.

The pump dispenser which incorporates the self-aligning feature of the invention is shown in detail in FIG. 2 as comprising a pump piston 21 reciprocable against the force of a piston return spring 22 within pump cylinder 19 to therewith define a variable volume pump chamber 23. An inlet ball check valve 24 is seated and caged within a lower throat section of the pump cylinder for valving product into the pump chamber during each piston return stroke through inlet 25 from the container via a dip tube 26 suspended from the accumulator and extending below the level of the liquid in the container as in any normal manner.

The pump dispenser assembly further comprises a hollow plunger stem 27 connected to the pump piston and mounted within a sleeve 28 for relative reciprocation, the sleeve being mounted on the upper end of the pump cylinder. The plunger head mounted on the upper end of the hollow stem may comprise a dispenser spout 29 defining a discharge passage 31, and an outlet ball check valve 32 being seated and caged within an upper end of the plunger stem for valving product, upon pump priming, from the pump chamber through the spout discharge during each piston pressure stroke.

In accordance with the invention, pump cylinder 19 has an eccentric circular flange 33 thereon having an axis non-coincident with the central axis of cylinder 19. Flange 33 supports closure 11, and has a diameter substantially the same as the outer diameter of container neck 16 so that, when the pump assembly is fully and appropriately mounted on the container, flange 33 contacts upper free edge 34 of the container neck to establish a tight seal between the pump assembly and the container.

Eccentric circular flange 33 presents a portion 35 of greatest extent from the pump cylinder given that flange 33 is offset from the pump cylinder axis. That portion 35 of greatest extent has a depending positioning leg 36 of a sufficient extent as to protrude into vent port 14 for properly positioning the pump assembly in the correct relative rotative position with the container. When the positioning lug extends into vent portion 14, flange 13 is coincident with container neck 16, and pump cylinder 19 is coincident with neck opening 18. Closure 11 may then be torqued down over the container neck without interference so as to assure that flange 33 seals completely around edge 34 of the container neck to avoid leakage during pumping and handling of the container.

It has been noted, however, that with only a positioning leg depending from flange 33, it is possible for the user to incorrectly position the pump assembly relative to the container by extending leg 36 into neck opening 18 just beyond either end of shelf 15 and still manage to thread the closure down over the container neck without knowledge by the user of the improper location of the pump. With such an improper orientation, however, flange 33 does not provide continuous (360 degree) contact with rim 34 of the container neck thereby resulting in leakage of product on tilting of the container. If the container has a caustic substance such as a laundry detergent in it, this presents a most undesirous and even hazardous condition.

Therefore, means such as an arcuate skirt 37 is provided depending from flange 33 of a curved extent which may be substantially the same as to overly shelf 15 in the proper position of the pump assembly. However, arcuate skirt 37 is designed such that should the pump assembly be oriented improperly with positioning leg 36 extending through some portion of neck opening 18 without extending through vent opening 14, arcuate skirt 37, which has an axis coincident with the axis of flange 33, will bear against edge 34 of the container neck in such a mis-oriented position so as to positively interfere with the torquing down of the closure on to the container neck. This will immediately remind the user that the pump assembly needs to be re-oriented into a proper position such that leg 36 is coincident with and extends into vent port 14 in order to properly mount the pump assembly in place. Arcuate skirt 37 is sufficiently shallow so as not to bear against shelf 15 in the proper installation of the pump assembly when the closure 11 is tightly threaded down over the container neck.

From the foregoing, it can be seen that a simple and economic yet highly effective self-aligning and anti-rotational means has been provided for the proper positioning of a manually actuated dispenser pump assembly relative to the constricted pour opening of a container of the type having a container vent built into the carrying handle for its initial intended use. Venting via the carrying handle is defeated when the pump assembly according to the invention is mounted in the place, although the pump has a standard vent port 38 located in the wall of pump cylinder 19 which is closed by pump piston 21, as shown in FIG. 2, in the at rest position of the pump. During each piston compression stroke, vent port 38 is exposed to the atmosphere via spacing between sleeve 28 and plunger stem 27 as in any normal manner for venting the inside of a container with air.

The positioning leg 36 depending from eccentric circular flange 33 extends into vent port 14 to both prevent relative rotation of the pump assembly to that of the container as well as to properly orient the pump assembly relative thereto. Closure 11 can in such position be tightly torqued down over the container neck with there being continuous 360 degree contact of rim 34 of the container neck by flange 33 which supports the closure. And, in any attempt to mis-orient the pump assembly relative to the container neck, as by extending the positioning leg to one side or the other of shelf 15, arcuate skirt 37 prevents the pump assembly from entering sufficiently deeply into the container to allow the closure threads to engage the bottle neck finish thereby preventing the user from torquing down the pump on the container until the pump has been rotated to its proper orientation. Skirt 37 extends a predetermined distance circumferentially on both sides of positioning leg 36. The skirt prevents the closure threads from engaging the container threads when the pump is inserted into the opening with the positioning leg being oriented such that the distal end of the positioning leg will not enter into the vent port 14. The user is thus cued to rotate the pump to the proper orientation at which position the pump will drop into the desired engagement with the container and the closure can be torqued down onto the container neck.

Obviously, many modifications and variations of the present invention are made possible in the light of the above teachings. It is therefore to be understood that within the scope of the appended claims, the invention may be practiced otherwise than as specifically described.

What is claimed is:

1. A manually actuated pump dispenser assembly having a threaded closure for mounting the dispenser assembly to a threaded cylindrical neck of a liquid container having a shelf projecting inwardly of the neck and constricting the size of the neck opening into the container, the assembly comprising a pump cylinder adapted to extend into the container through the neck opening, the pump cylinder having an eccentric circular flange overlying the cylindrical neck and coaxial therewith, the eccentric flange presenting a portion of greatest extension from the pump cylinder, said portion having a depending positioning leg extending into an opening in said shelf for the proper orientation of the assembly to the neck opening, and means on said eccentric flange portion for interfering with threaded engagement between the closure and the neck in all relative rotative positions of the pump cylinder except when in the proper orientation.

2. The assembly according to claim 1, wherein said interfering means comprises a depending skirt lying on opposite sides of the positioning leg.

3. The assembly according to claim 1, wherein said interfering means comprises a depending arcuate skirt overlying only said shelf in said proper orientation.

4. The assembly according to claim 1, wherein said interfering means comprises a depending arcuate skirt from which said leg extends.

5. A manually actuated dispensing pump assembly having a pump piston and a cylinder unit, the piston having a hollow plunge stem, a plunger head on the stem, the head having a discharge spout, a circular flange on the pump cylinder, and a threaded closure cap in engagement with the flange for mounting the assembly to a liquid container, the improvement wherein the circular flange lies eccentric to the central axis of the pump cylinder and presents a portion of greatest extension from the pump cylinder, said portion having a depending positioning lug for the proper orientation of the assembly in an eccentric opening of a neck of the container, and means on said eccentric flange portion for interfering with threadedly mounting the assembly to the container except in the proper orientation.

6. The assembly according to claim 5, wherein said interfering means comprises a depending arcuate skirt lying on opposite sides of the positioning leg.

7. The assembly according to claim 5, wherein said interfering means comprises a depending arcuate skirt from which the positioning leg extends.

8. A manually actuated dispensing pump assembly for self-aligning the assembly to an eccentric container neck opening, the assembly comprising a pump cylinder having an eccentric circular flange supporting a threaded closure for mounting the assembly on the container neck, the eccentric circular flange presenting a portion of greatest extension from the pump cylinder, a positioning leg extending from said portion parallel to said cylinder for the proper orientation without rotation of the assembly relative to the neck opening, and means on said portion associated with the leg for preventing mounting the assembly to the container neck in all rotative positions of the pump cylinder except in the proper orientation.

9. The assembly according to claim 8, wherein said means comprises an arcuate skirt extending from opposite sides of the positioning leg.

10. The assembly according to claim 8, wherein said means comprises an arcuate skirt from which said positioning leg extends.

* * * * *